US009839814B2

(12) United States Patent
Sullivan et al.

(10) Patent No.: US 9,839,814 B2
(45) Date of Patent: Dec. 12, 2017

(54) MULTI-LAYER GOLF BALL

(71) Applicant: Acushnet Company, Fairhaven, MA (US)

(72) Inventors: Michael J. Sullivan, Old Lyme, CT (US); Robert Blink, Newport, RI (US); David A. Bulpett, Boston, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 14/586,537

(22) Filed: Dec. 30, 2014

(65) Prior Publication Data

US 2016/0184659 A1 Jun. 30, 2016

(51) Int. Cl.
*A63B 37/00* (2006.01)

(52) U.S. Cl.
CPC ..... *A63B 37/0027* (2013.01); *A63B 37/0031* (2013.01); *A63B 37/0033* (2013.01); *A63B 37/0039* (2013.01); *A63B 37/0043* (2013.01); *A63B 37/0045* (2013.01); *A63B 37/0046* (2013.01); *A63B 37/0051* (2013.01); *A63B 37/0062* (2013.01); *A63B 37/0063* (2013.01); *A63B 37/0064* (2013.01); *A63B 37/0075* (2013.01); *A63B 37/0076* (2013.01); *A63B 37/0092* (2013.01); *A63B 2037/0079* (2013.01)

(58) Field of Classification Search
CPC ..... A63B 37/0031; A63B 37/0033; A63B 37/0034; A63B 37/0043; A63B 37/0045; A63B 37/0046; A63B 37/0062; A63B 37/0063; A63B 37/0072; A63B 37/0079; A63B 37/0092
See application file for complete search history.

(56) References Cited

U.S. PATENT DOCUMENTS 6,299,551 B1 * 10/2001 Higuchi ..... A63B 37/0003 473/374
6,592,471 B1 * 7/2003 Watanabe ..... A63B 37/0003 473/351
7,722,483 B2 * 5/2010 Morgan ..... A63B 37/12 473/378
7,887,437 B2 2/2011 Sullivan et al.
8,168,710 B2 5/2012 Rajagopalan et al.
2002/0086931 A1 * 7/2002 Ladd ..... A63B 37/0003 524/432
2003/0083155 A1 * 5/2003 Endo ..... A63B 37/0003 473/371
2005/0239577 A1 * 10/2005 Watanabe ..... A63B 37/0003 473/371
2005/0261424 A1 * 11/2005 Snell ..... A63B 37/0003 525/7
2008/0132358 A1 * 6/2008 Komatsu ..... A63B 37/0063 473/373
2008/0153628 A1 * 6/2008 Makino ..... A63B 37/0075 473/376
2010/0062876 A1 * 3/2010 Shinohara ..... A63B 37/0031 473/376
2010/0190580 A1 * 7/2010 Higuchi ..... A63B 37/0087 473/373
2010/0298067 A1 * 11/2010 Watanabe ..... A63B 37/0063 473/373
2010/0331109 A1 * 12/2010 Sullivan ..... A63B 37/0003 473/373
2010/0331110 A1 * 12/2010 Hebert ..... A63B 37/0003 473/373
2010/0331111 A1 * 12/2010 Sullivan ..... A63B 37/0039 473/373
2011/0092314 A1 * 4/2011 Higuchi ..... A63B 37/0003 473/373
2012/0115638 A1 5/2012 Bulpett et al.
2012/0122608 A1 5/2012 Bulpett et al.
2013/0046060 A1 * 2/2013 Tarao ..... A63B 37/0003 525/228
2013/0274032 A1 * 10/2013 Kasashima ..... A63B 37/0003 473/371
2013/0324321 A1 * 12/2013 Sajima ..... A63B 37/0054 473/373
2014/0187351 A1 * 7/2014 Nakamura ..... A63B 37/0023 473/373

OTHER PUBLICATIONS

Compressions by any other name—J. Dalton.*
Shore Durometer Conversion Chart.*

* cited by examiner

*Primary Examiner* — John E Simms, Jr.
(74) *Attorney, Agent, or Firm* — Mandi B. Milbank

(57) ABSTRACT

Multi-layer golf balls comprising a single- or dual-layer core, an intermediate layer, and an outer cover layer are disclosed. The intermediate layer is formed from a thermoplastic elastomer composition and has a surface hardness which is greater than the center hardness of the core and less than the outer surface hardness of the core. The outer surface hardness of the outer cover layer is greater than the outer surface hardness of the core.

20 Claims, No Drawings

MULTI-LAYER GOLF BALL

FIELD OF THE INVENTION

The present invention generally relates to golf balls, and more particularly to golf balls having an intermediate layer formed from a thermoplastic elastomer composition. The outer surface hardness of the intermediate layer is greater than the center hardness of the core and less than the outer surface hardness of the core.

BACKGROUND OF THE INVENTION

Numerous golf balls having a multilayer construction wherein the core hardness and cover hardness have been variously improved are disclosed in the prior art. For example, U.S. Pat. No. 6,987,159 to Iwami discloses a solid golf ball with a solid core and a polyurethane cover, wherein the difference in Shore D hardness between a center portion and a surface portion of the solid core is at least 15, the polyurethane cover has a thickness (t) of not more than 1.0 mm and is formed from a cured urethane composition having a Shore D hardness (D) of from 35 to 60, and a product of t and D ranges from 10 to 45.

U.S. Pat. No. 7,175,542 to Watanabe et al. discloses a multi-piece solid golf ball composed of a multilayer core having at least an inner core layer and an outer core layer, one or more cover layers which enclose the core, and numerous dimples formed on a surface of the cover layer. The golf ball is characterized in that the following hardness conditions are satisfied:

(1) (JIS-C hardness of cover)−(JIS-C hardness at center of core)≥27, (2) 23≤(JIS-C hardness at surface of core)−(JIS-C hardness at center of core)≤40, and (3) 0.50≤[(deflection amount of entire core)/(deflection amount of inner core layer)]≤0.75.

U.S. Pat. No. 6,679,791 to Watanabe discloses a multi-piece golf ball which includes a rubbery elastic core, a cover having a plurality of dimples on the surface thereof, and at least one intermediate layer between the core and the cover. The intermediate layer is composed of a resin material which is harder than the cover. The elastic core has a hardness which gradually increases radially outward from the center to the surface thereof. The center and surface of the elastic core have a hardness difference of at least 18 JIS-C hardness units.

U.S. Pat. No. 5,782,707 to Yamagishi et al. discloses a three-piece solid golf ball consisting of a solid core, an intermediate layer, and a cover, wherein the hardness is measured by a JIS-C scale hardness meter, the core center hardness is up to 75 degrees, the core surface hardness is up to 85 degrees, the core surface hardness is higher than the core center hardness by 8 to 20 degrees, the intermediate layer hardness is higher than the core surface hardness by at least 5 degrees, and the cover hardness is lower than the intermediate layer hardness by at least 5 degrees.

U.S. Pat. No. 7,887,437 to Sullivan et al. discloses golf balls consisting of a dual core and a dual cover, wherein the dual core consists of an inner core layer formed from a rubber composition and an outer core layer formed from a highly neutralized polymer composition. The Shore C hardness of the outer core layer's outer surface is greater than the material hardness of the inner cover layer, and is preferably 75 Shore C or greater.

Additional examples can be found, for example, in U.S. Pat. No. 6,686,436 to Iwami, U.S. Pat. No. 6,786,836 to Higuchi et al., U.S. Pat. No. 7,086,969 to Higuchi et al., U.S. Pat. No. 7,153,224 to Higuchi et al., and U.S. Pat. No. 7,226,367 to Higuchi et al.

The present invention provides a novel multilayer golf ball construction which provides desirable spin and distance properties.

SUMMARY OF THE INVENTION

The present invention is directed to a golf ball having a compression of from 30 to 90 and comprising a center or a dual core, an intermediate layer, and an outer cover layer. Three-layer golf balls of the present invention include a center having a diameter of from 1.25 inches to 1.55 inches, a center Shore C hardness ($H_{center}$) of from 45 to 70, an outer surface Shore C hardness ($H_{core\ surface}$) of from 80 to 95, and are formed from a rubber composition. Four-layer golf balls of the present invention include a dual core having an outer diameter of from 1.25 inches to 1.55 inches, a center Shore C hardness ($H_{center}$) of from 45 to 70, an outer surface Shore C hardness ($H_{core\ surface}$) of from 80 to 95, and consist of a center formed from a first rubber composition and an outer core layer formed from a second rubber composition. The intermediate layer has an outer surface Shore C hardness ($H_{intermediate\ surface}$) of from 55 to 80, a thickness of from 0.020 inches to 0.120 inches, and is formed from a polyester elastomer composition having a material hardness of from 50 Shore C to 80 Shore C. The polyester elastomer composition of the intermediate layer comprises a polyester elastomer and an additional polymer selected from the group consisting of polyolefins, polyamides, polyesters, polyethers, polyurethanes, metallocene-catalyzed polymers, single-site catalyst polymerized polymers, ethylene propylene rubber, ethylene propylene diene rubber, styrenic block copolymer rubbers, alkyl acrylate rubbers, chlorinated polyethylene, polyvinyl chloride, chlorinated polyvinyl chloride, and functionalized derivatives thereof. The polyester elastomer is present in an amount of from 20 wt % to 90 wt %, based on the combined weight of the polyester elastomer and the additional polymer, and the additional polymer is present in an amount of from 10 wt % to 80 wt %, based on the combined weight of the polyester elastomer and the additional polymer. The outer cover layer has an outer surface Shore C hardness ($H_{outer\ cover\ surface}$) of from 75 to 99 and a thickness of from 0.020 inches to 0.080 inches. $H_{intermediate\ surface}$ is greater than $H_{center}$ and less than $H_{core\ surface}$. $H_{outer\ cover\ surface}$ is greater than $H_{core\ surface}$. The difference between $H_{core\ surface}$ and $H_{intermediate\ surface}$ is from 5 to 30.

DETAILED DESCRIPTION

Multi-layer golf balls comprising a single- or dual-layer core, an intermediate layer, and an outer cover layer are disclosed. The intermediate layer is formed from a thermoplastic elastomer composition and has a surface Shore C hardness ($H_{intermediate\ surface}$) which is greater than the center Shore C hardness of the core ($H_{center}$) and less than the outer surface Shore C hardness of the core ($H_{core\ surface}$). The outer surface Shore C hardness of the outer cover layer ($H_{outer\ cover\ surface}$) is greater than the outer surface Shore C hardness of the core.

Single-layer cores of the present invention consist of a center having a diameter of 1.00 or 1.20 or 1.25 or 1.30 or 1.35 or 1.40 or 1.50 or 1.51 or 1.52 or 1.53 or 1.54 or 1.55 or 1.57 or 1.59 inches, or a diameter within a range having a lower limit and an upper limit selected from these values.

Dual-layer cores of the present invention consist of a center and an outer core layer. The center has a diameter of 0.75 or 1.00 or 1.20 or 1.25 or 1.30 or 1.35 or 1.40 or 1.50 or 1.51 or 1.52 or 1.53 or 1.54 or 1.55 or 1.57 inches, or a diameter within a range having a lower limit and an upper limit selected from these values. The outer core layer encloses the center such that the dual core has an overall diameter of 1.00 or 1.20 or 1.25 or 1.30 or 1.35 or 1.40 or 1.50 or 1.51 or 1.52 or 1.53 or 1.54 or 1.55 or 1.57 or 1.59 inches, or a diameter within a range having a lower limit and an upper limit selected from these values.

Single- and dual-layer cores of the present invention have a center Shore C hardness ($H_{center}$) of 40 or greater, or 45 or greater, or 50 or greater, or 55 or greater, or 60 or greater, or a center Shore C hardness of 40 or 45 or 50 or 55 or 60 or 65 or 70 or 75, or a center Shore C hardness within a range having a lower limit and an upper limit selected from these values, and an outer surface Shore C hardness ($H_{core\ surface}$) of 70 or greater, or 75 or greater, or 80 or greater, or an outer surface Shore C hardness of 70 or 75 or 80 or 85 or 90 or 95, or an outer surface Shore C hardness within a range having a lower limit and an upper limit selected from these values.

Single- and dual-layer cores of the present invention have an overall positive hardness gradient wherein the center Shore C hardness is at least 10 Shore C units less than, or at least 15 Shore C units less than, or at least 20 Shore C units less than, or at least 25 Shore C units less than, or at least 30 Shore C units less than, or at least 35 Shore C units less than the outer surface Shore C hardness of the core, or the core has a positive hardness gradient wherein the difference between the center Shore C hardness of the core and the outer surface Shore C hardness of the core is 5 or 10 or 15 or 20 or 25 or 30 or 35 or 40 Shore C units or is within a range having a lower limit and an upper limit selected from these values. In dual core embodiments, the center may have a negative hardness gradient wherein the interface hardness of the center ($H_{center\ interface}$) is less than the center hardness, or a zero hardness gradient wherein the interface hardness of the center is within 1 hardness unit of the center hardness, or a positive hardness gradient wherein the interface hardness of the center is greater than the center hardness. The interface hardness of the center is defined herein as the hardness at a distance of 1 mm inward from the outer surface of the center. In a particular embodiment, the center has an overall zero hardness gradient; or a positive hardness gradient wherein $$1<H_{center\ interface}-H_{center}<45,$$

$$\text{or } 1<H_{center\ interface}-H_{center}<15,$$

$$\text{or } 1<H_{center\ interface}-H_{center}<5;$$

or a negative hardness gradient wherein $$1<H_{center}-H_{center\ interface}<45,$$

$$\text{or } 1<H_{center}-H_{center\ interface}<15,$$

$$\text{or } 1<H_{center}-H_{center\ interface}<5.$$

The intermediate layer has an outer surface Shore C hardness ($H_{intermediate\ surface}$) which is greater than $H_{center}$ and less than $H_{core\ surface}$. In a particular embodiment, the difference between $H_{core\ surface}$ and $H_{intermediate\ surface}$ is 5 or 10 or 15 or 20 or 25 or 30 or 35, or the difference between $H_{core\ surface}$ and $H_{intermediate\ surface}$ is within a range having a lower limit and an upper limit selected from these values.

The outer surface Shore C hardness of the intermediate layer is typically 50 or greater, or 55 or greater, or 60 or greater, or 80 or less, or 75 or less, or 70 or less. In a particular embodiment, the intermediate layer has an outer surface Shore C hardness of 50 or 55 or 60 or 65 or 70 or 75 or 80, or an outer surface Shore C hardness within a range having a lower limit and an upper limit selected from these values.

The outer cover layer has an outer surface Shore C hardness ($H_{outer\ cover\ surface}$) which is greater than $H_{core\ surface}$, and, in a particular embodiment, is the highest outer surface Shore C hardness of any layer of the golf ball. In a particular embodiment, the difference between $H_{outer\ cover\ surface}$ and $H_{intermediate\ surface}$ is 5 or 10 or 15 or 20 or 25 or 30 or 35 or 40 or 45, or the difference between $H_{outer\ cover\ surface}$ and $H_{intermediate\ surface}$ is within a range having a lower limit and an upper limit selected from these values.

The outer surface Shore C hardness of the outer cover layer is typically 75 or greater, or greater than 75, or greater than 80, or 85 or greater, or 90 or greater, or 95 or greater. In a particular embodiment, the outer cover layer has an outer surface Shore C hardness of 75 or 80 or 82 or 85 or 90 or 95 or 99, or an outer surface Shore C hardness within a range having a lower limit and an upper limit selected from these values. In another particular embodiment, the outer cover layer has an outer surface Shore D hardness of 55 or 60 or 65 or 70 or 75 or 80, or an outer surface Shore D hardness within a range having a lower limit and an upper limit selected from these values.

The core layer(s) are preferably formed from the same or different rubber compositions. Suitable rubber compositions include a base rubber selected from natural rubber, polybutadiene, polyisoprene, ethylene propylene rubber (EPR), ethylene-propylene-diene rubber (EPDM), styrene butadiene rubber, styrenic block copolymer rubbers, butyl rubber, halobutyl rubber, polystyrene elastomers, polyethylene elastomers, polyurethane elastomers, polyurea elastomers, metallocene-catalyzed elastomers and plastomers, acrylonitrile butadiene rubber, copolymers of isobutylene and para-alkylstyrene, halogenated copolymers of isobutylene and para-alkylstyrene, copolymers of butadiene with acrylonitrile, polychloroprene, alkyl acrylate rubber, chlorinated isoprene rubber, acrylonitrile chlorinated isoprene rubber, polyalkenamer, phenol formaldehyde, melamine formaldehyde, polyepoxide, polysiloxane, polyester, alkyd, polyisocyanurate, polycyanurate, polyacrylate, and combinations of two or more thereof. Diene rubbers are preferred, particularly polybutadiene, styrene butadiene, acrylonitrile butadiene, and mixtures of polybutadiene with other elastomers wherein the amount of polybutadiene present greater than 40 wt % based on the total polymeric weight of the mixture.

In a particular embodiment, the core is a solid, single layer formed from a polybutadiene blend composition comprising a first polybutadiene and a second polybutadiene. In a particular aspect of this embodiment, the core composition further comprises styrene butadiene rubber. In another particular aspect of this embodiment, the first polybutadiene is present in the core composition in an amount of 50 phr or greater, or 60 phr or greater, or 65 phr or greater, or 70 phr or greater, or 75 phr or greater, or 80 phr or greater. In another particular aspect of this embodiment, the second polybutadiene is present in the core composition in an amount of 10 phr or greater, or 15 phr or greater, or 20 phr or greater. In another particular aspect of this embodiment, the styrene butadiene rubber is optionally present in the core composition in an amount of 3 phr or greater, or 5 phr or greater. In dual core embodiments of the present invention, the center and the outer core layer may be formed from the same or different rubber compositions.

Non-limiting examples of suitable commercially available rubbers are Buna CB high-cis neodymium-catalyzed polybutadiene rubbers, such as Buna CB 23, Buna CB24, and Buna CB high-cis cobalt-catalyzed polybutadiene rubbers, such as Buna CB 1203, 1220 and 1221, commercially available from Lanxess Corporation; SE BR-1220, commercially available from The Dow Chemical Company; Europrene® NEOCIS® BR 40 and BR 60, commercially available from Polimeri Europa®; UBEPOL-BR® rubbers, commercially available from UBE Industries, Inc.; BR 01, commercially available from Japan Synthetic Rubber Co., Ltd.; Neodene high-cis neodymium-catalyzed polybutadiene rubbers, such as Neodene BR 40, commercially available from Karbochem; TP-301 transpolyisoprene, commercially available from Kuraray Co., Ltd.; Vestenamer® polyoctenamer, commercially available from Evonik Industries; Butyl 065 and Butyl 288 butyl rubbers, commercially available from ExxonMobil Chemical Company; Butyl 301 and Butyl 101-3, commercially available from Lanxess Corporation; Bromobutyl 2224 and Chlorobutyl 1066 halobutyl rubbers, commercially available from ExxonMobil Chemical Company; Bromobutyl X2 and Chlorobutyl 1240 halobutyl rubbers, commercially available from Lanxess Corporation; BromoButyl 2255 butyl rubber, commercially available from Japan Synthetic Rubber Co., Ltd.; Vistalon® 404 and Vistalon® 706 ethylene propylene rubbers, commercially available from ExxonMobil Chemical Company; Dutral CO 058 ethylene propylene rubber, commercially available from Polimeri Europa; Nordel® IP NDR 5565 and Nordel® IP 3670 ethylene-propylene-diene rubbers, commercially available from The Dow Chemical Company; EPT1045 and EPT1045 ethylene-propylene-diene rubbers, commercially available from Mitsui Corporation; Buna SE 1721 TE styrene-butadiene rubbers, commercially available from Lanxess Corporation; Afpol 1500 and Afpol 552 styrene-butadiene rubbers, commercially available from Karbochem; Plioflex PLF 1502, commercially available from Goodyear Chemical; Nipol® DN407 and Nipol® 1041L acrylonitrile butadiene rubbers, commercially available from Zeon Chemicals, L.P.; Neoprene GRT and Neoprene AD30 polychloroprene rubbers; Vamac® ethylene acrylic elastomers, commercially available from E. I. du Pont de Nemours and Company; Hytemp® AR12 and AR214 alkyl acrylate rubbers, commercially available from Zeon Chemicals, L.P.; Hypalon® chlorosulfonated polyethylene rubbers, commercially available from E. I. du Pont de Nemours and Company; and Goodyear Budene® 1207 polybutadiene, commercially available from Goodyear Chemical. In a particular embodiment, the core is formed from a rubber composition comprising as the base rubber a blend of Neodene BR 40 polybutadiene, Budene® 1207 polybutadiene, and Buna SB 1502 styrene butadiene rubber. In another particular embodiment, the core is formed from a rubber composition comprising as the base rubber a blend of Neodene BR 40 polybutadiene, Buna CB 1221, and core regrind.

The rubber is crosslinked using, for example, a peroxide or sulfur cure system, C-C initiators, high energy radiation sources capable of generating free radicals, or a combination thereof.

In a particular embodiment, the rubber is crosslinked using a peroxide initiator and optionally a coagent. Suitable peroxide initiators include, but are not limited to, organic peroxides, such as dicumyl peroxide; n-butyl-4,4-di(t-butylperoxy)valerate; 1,1-di(t-butylperoxy)3,3,5-trimethylcyclohexane; 2,5-dimethyl-2,5-di(t-butylperoxy)hexane; di-t-butyl peroxide; di-t-amyl peroxide; t-butyl peroxide; t-butyl cumyl peroxide; 2,5-dimethyl-2,5-di(t-butylperoxy)hexyne-3; di(2-t-butyl-peroxyisopropyl)benzene; dilauroyl peroxide; dibenzoyl peroxide; t-butyl hydroperoxide; lauryl peroxide; benzoyl peroxide; and combinations thereof. Examples of suitable commercially available peroxides include, but are not limited to Perkadox® BC dicumyl peroxide, commercially available from Akzo Nobel, and Varox® peroxides, such as Varox® ANS benzoyl peroxide and Varox® 231 1,1-di(t-butylperoxy)3,3,5-trimethylcyclohexane, commercially available from RT Vanderbilt Company, Inc.

The amount of peroxide initiator used to form the rubber composition is generally at least 0.05 parts by weight per 100 parts of the base rubber, or is 0.05 parts or 0.1 parts or 0.25 parts or 0.6 parts or 0.8 parts or 1 part or 1.25 parts or 1.5 parts or 2.0 parts or 2.5 parts or 3 parts or 5 parts or 6 parts or 10 parts or 15 parts by weight per 100 parts of the base rubber, or is within a range having a lower limit and an upper limit selected from these values.

Coagents are commonly used with peroxides to increase the state of cure. Suitable coagents include, but are not limited to, metal salts of unsaturated carboxylic acids; unsaturated vinyl compounds and polyfunctional monomers (e.g., trimethylolpropane trimethacrylate); maleimides (e.g., phenylene bismaleimide); and combinations thereof. Particular examples of suitable metal salts of unsaturated carboxylic acids include, but are not limited to, one or more metal salts of acrylates, diacrylates, methacrylates, and dimethacrylates, wherein the metal is selected from magnesium, calcium, zinc, aluminum, lithium, nickel, and sodium. In a particular embodiment, the coagent is selected from zinc salts of acrylates, diacrylates, methacrylates, dimethacrylates, and mixtures thereof. In another particular embodiment, the coagent is zinc diacrylate.

When the coagent is zinc diacrylate and/or zinc dimethacrylate, the amount of coagent used to form the rubber composition is generally 1 or 5 or 10 or 15 or 19 or 20 or 24 or 25 or 30 or 35 or 40 or 45 or 50 or 60 parts by weight per 100 parts of the base rubber, or is within a range having a lower limit and an upper limit selected from these values. When one or more less active coagents are used, such as zinc monomethacrylate and various liquid acrylates and methacrylates, the amount of less active coagent used may be the same as or higher than for zinc diacrylate and zinc dimethacrylate coagents.

In another particular embodiment, the rubber is crosslinked using sulfur and/or an accelerator. Suitable accelerators include, but are not limited to, guanidines (e.g., diphenyl guanidine, triphenyl guanidine, and di-ortho-tolyl guanidine); thiazoles (e.g., mercaptobenzothiazole, dibenzothiazyldisulfide, sodium salt of mercaptobenzothiazole, zinc salt of mercaptobenzothiazole, and 2,4-dinitrophenyl mercaptobenzothiazole); sulfenamides (e.g., N-cyclohexylbenzothiazylsulfenamide, N-oxydiethylbenzothiazylsulfenamide, N-t-butylbenzothiazylsulfenamide, and N,N'-dicyclohexylbenzothiazylsulfenamide); thiuram sulfides (e.g., tetramethyl thiuram disulfide, tetraethyl thiuram disulfide, tetrabutylthiuram disulfide, tetramethyl thiuram monosulfide, dipentamethylene thiuram tetrasulfate, 4-morpholinyl-2-benzothiazole disulfide, and dipentamethylenethiuram hexasulfide); dithiocarbamates (e.g., piperidine pentamethylene dithiocarbamate, zinc diethyl dithiocarbamate, sodium diethyl dithiocarbamate, zinc ethyl phenyl dithiocarbamate, and bismuth dimethyldithiocarbamate); thioureas (e.g., ethylene thiourea, N,N'-diethylthiourea, and N,N'-diphenylthiourea); xanthates (e.g., zinc isopropyl xanthate, sodium isopropyl xanthate, and zinc butyl xanthate); dithiophosphates; and aldehyde amines (e.g., hexamethylene tetramine and ethylidene aniline).

The crosslinking system optionally includes one or more activators selected from metal oxides (e.g., zinc oxide and magnesium oxide), and fatty acids and salts of fatty acids (e.g., stearic acid, zinc stearate, oleic acid, and dibutyl ammonium oleate).

The rubber composition optionally includes a scorch retarder to prevent scorching of the rubber during processing before vulcanization. Suitable scorch retarders include, but are not limited to, salicylic acid, benzoic acid, acetylsalicylic acid, phthalic anhydride, sodium acetate, and N-cyclohexylthiophthalimide.

The rubber composition optionally includes one or more antioxidants to inhibit or prevent the oxidative degradation of the base rubber. Some antioxidants also act as free radical scavengers; thus, when antioxidants are included in the composition, the amount of initiator agent used may be as high as or higher than the amounts disclosed herein. Suitable antioxidants include, but are not limited to, hydroquinoline antioxidants, phenolic antioxidants, and amine antioxidants.

The rubber composition optionally includes a soft and fast agent selected from organosulfur and metal-containing organosulfur compounds; organic sulfur compounds, including mono, di, and polysulfides, thiol, and mercapto compounds; inorganic sulfide compounds; blends of an organosulfur compound and an inorganic sulfide compound; Group VIA compounds; substituted and unsubstituted aromatic organic compounds that do not contain sulfur or metal; aromatic organometallic compounds; hydroquinones; benzoquinones; quinhydrones; catechols; resorcinols; and combinations thereof. In a particular embodiment, the soft and fast agent is selected from zinc pentachlorothiophenol, pentachlorothiophenol, ditolyl disulfide, diphenyl disulfide, dixylyl disulfide, 2-nitroresorcinol, and combinations thereof.

The rubber composition optionally contains one or more fillers. Exemplary fillers include precipitated hydrated silica, clay, talc, asbestos, glass fibers, aramid fibers, mica, calcium metasilicate, zinc sulfate, barium sulfate, zinc sulfide, lithopone, silicates, silicon carbide, diatomaceous earth, carbonates (e.g., calcium carbonate, zinc carbonate, barium carbonate, and magnesium carbonate), metals (e.g., titanium, tungsten, aluminum, bismuth, nickel, molybdenum, iron, lead, copper, boron, cobalt, beryllium, zinc, and tin), metal alloys (e.g., steel, brass, bronze, boron carbide whiskers, and tungsten carbide whiskers), oxides (e.g., zinc oxide, tin oxide, iron oxide, calcium oxide, aluminum oxide, titanium dioxide, magnesium oxide, and zirconium oxide), particulate carbonaceous materials (e.g., graphite, carbon black, cotton flock, natural bitumen, cellulose flock, and leather fiber), microballoons (e.g., glass and ceramic), fly ash, core material that is ground and recycled, nanofillers and combinations thereof.

The rubber composition may also contain one or more additives selected from processing aids, such as transpolyisoprene (e.g., TP-301 transpolyisoprene, commercially available from Kuraray Co., Ltd.), transbutadiene rubber, and polyalkenamer rubber; processing oils; plasticizers; coloring agents; fluorescent agents; chemical blowing and foaming agents; defoaming agents; stabilizers; softening agents; impact modifiers; free radical scavengers; antiozonants (e.g., p-phenylenediames); and the like.

Suitable types and amounts of rubber, initiator agent, coagent, filler, and additives are more fully described in, for example, U.S. Pat. Nos. 6,566,483, 6,695,718, 6,939,907, 7,041,721 and 7,138,460, the entire disclosures of which are hereby incorporated herein by reference. Particularly suitable diene rubber compositions are further disclosed, for example, in U.S. Patent Application Publication No. 2007/0093318, the entire disclosure of which is hereby incorporated herein by reference.

The intermediate layer has a thickness of 0.020 or 0.030 or 0.060 or 0.120 inches, or a thickness within a range having a lower limit and an upper limit selected from these values.

The intermediate layer composition has a solid sphere coefficient of restitution ("COR") of from 0.700 to 0.850. For purposes of the present disclosure, the "solid sphere COR" of a composition refers to the COR of a 1.550 inch solid sphere formed from the composition.

The intermediate layer composition has a solid sphere compression of from −50 to 50. For purposes of the present disclosure, the "solid sphere compression" of a composition refers to the compression of a 1.550 inch solid sphere formed from the composition. In a particular embodiment, the ratio of the compression of the golf ball to the solid sphere compression of the intermediate layer composition is less than 1.00.

The intermediate layer is formed from a thermoplastic elastomer ("TPE") composition. TPEs include, for example, styrenic block copolymers, polyolefin blends, elastomeric alloys, thermoplastic polyurethanes, thermoplastic polyesters, and thermoplastic polyamides. Examples of suitable commercially available TPEs include, but are not limited to, Kraton® styrenic block copolymers, commercially available from Kraton Performance Polymers Inc.; Septon® styrenic block copolymers, commercially available from Kuraray Co., Ltd.; Hytrel® polyester elastomers, and particularly Hytrel® 3078, 4069, and 556, commercially available from E. I. du Pont de Nemours and Company; Riteflex® polyester elastomers, commercially available from Celanese Corporation; Pelprene® polyester elastomers, commercially available from Toyobo Co., Ltd.; Pebax® thermoplastic polyether block amides, and particularly Pebax® 2533, 3533, 4033, and 5533, commercially available from Arkema Inc.; Dynaron® thermoplastic elastomers, commercially available from JSR Corporation; and Rabalon® thermoplastic elastomers, commercially available from Mitsubishi Chemical Corporation; and blends of two or more thereof.

The intermediate layer is preferably formed from a TPE composition having a material hardness of from 50 Shore C to 80 Shore C and comprising a TPE and an additional polymer component. In a particular embodiment, the TPE is a polyester elastomer, preferably having a material hardness of from 30 Shore D to 50 or 55 Shore D. Preferably, the polyester elastomer is present in an amount of from 20 wt % to 90 wt % and the additional polymer is present in an amount of from 10 wt % to 80 wt %, based on the combined weight of the polyester elastomer and the additional polymer. In another particular embodiment, the polyester elastomer is present in an amount of from 20 wt % to 45 wt % and the additional polymer is present in an amount of from 55 wt % to 80 wt %, based on the combined weight of the polyester elastomer and the additional polymer. In another particular embodiment, the polyester elastomer is present in an amount of from 55 wt % to 90 wt % and the additional polymer is present in an amount of from 10 wt % to 45 wt %, based on the combined weight of the polyester elastomer and the additional polymer.

The additional polymer of the intermediate layer composition is selected from acid polymers and non-acid polymers.

Suitable acid polymers are copolymers of an α-olefin and a $C_3$-$C_8$ α,β-ethylenically unsaturated carboxylic acid, optionally including a softening monomer selected from the group consisting of alkyl acrylates and methacrylates. It is understood that the acid copolymer may be a blend of two or more different acid copolymers. The acid is typically present in the acid copolymer in an amount within a range having a lower limit of 1 or 10 or 12 or 15 or 20 wt % and an upper limit of 25 or 30 or 35 or 40 wt %, based on the total weight of the acid copolymer. The α-olefin is preferably selected from ethylene and propylene. The acid is preferably selected from (meth) acrylic acid, ethacrylic acid, maleic acid, crotonic acid, fumaric acid, and itaconic acid. (Meth) acrylic acid is particularly preferred.

Suitable acid polymers also include partially and fully neutralized acid polymers, wherein the acid copolymer is reacted with a cation source, optionally in the presence of a high molecular weight organic acid or salt thereof, such that at least 70%, or at least 80%, or at least 90%, or at least 95%, or 100%, of all acid groups present in the composition are neutralized.

Suitable cation sources include, but are not limited to, metal ions and compounds of alkali metals, alkaline earth metals, and transition metals; metal ions and compounds of rare earth elements; ammonium salts and monoamine salts; and combinations thereof. Preferred cation sources are metal ions and compounds of magnesium, sodium, potassium, cesium, calcium, barium, manganese, copper, zinc, tin, lithium, and rare earth metals.

Suitable high molecular weight organic acids and salts thereof are aliphatic organic acids, aromatic organic acids, saturated mono-functional organic acids, unsaturated mono-functional organic acids, multi-unsaturated mono-functional organic acids, dimerized derivatives thereof, the salts particularly the barium, lithium, sodium, zinc, bismuth, chromium, cobalt, copper, potassium, strontium, titanium, tungsten, magnesium, and calcium salts thereof, and blends of two or more thereof. Particular examples of suitable organic acids include, but are not limited to, caproic acid, caprylic acid, capric acid, lauric acid, stearic acid, behenic acid, erucic acid, oleic acid, linoleic acid, myristic acid, benzoic acid, palmitic acid, phenylacetic acid, naphthalenoic acid, dimerized derivatives thereof, salts thereof, and blends of two or more thereof. Suitable organic acids are more fully described, for example, in U.S. Pat. No. 6,756,436, the entire disclosure of which is hereby incorporated herein by reference.

Examples of suitable acid polymers, partially neutralized acid polymers, and highly neutralized acid polymers include, but are not limited to, Nucrel® acid polymers, commercially available from E. I. du Pont de Nemours and Company; Escor® acid polymers, commercially available from ExxonMobil Chemical Company; A-C® acid polymers, commercially available from Honeywell International Inc.; Primacor® acid polymers and XUS acid polymers, commercially available from The Dow Chemical Company; Surlyn® ionomers, commercially available from E. I. du Pont de Nemours and Company; AClyn® ionomers, commercially available from Honeywell International Inc.; and Iotek® ionomers, commercially available from ExxonMobil Chemical Company. Particularly suitable are DuPont® HPF 1000, HPF 2000, HPF AD1035, and HPF AD1035 Soft, ionomeric materials commercially available from E. I. du Pont de Nemours and Company.

Additional suitable acid polymers are more fully described, for example, in U.S. Pat. Nos. 6,562,906, 6,762,246, and 6,953,820 and U.S. Patent Application Publication Nos. 2005/0049367, 2005/0020741, and 2004/0220343, the entire disclosures of which are hereby incorporated herein by reference.

Suitable non-acid polymers include, for example, polyolefins, polyamides, polyesters, polyethers, polyurethanes, metallocene-catalyzed polymers, single-site catalyst polymerized polymers, ethylene propylene rubber, ethylene propylene diene rubber, styrenic block copolymer rubbers, alkyl acrylate rubbers, chlorinated polyethylene, polyvinyl chloride, chlorinated polyvinyl chloride, and functionalized derivatives thereof.

In a particular embodiment, the additional polymer is an elastomeric polymer selected from the group consisting of:

(a) ethylene-alkyl acrylate polymers, particularly polyethylene-butyl acrylate, polyethylene-methyl acrylate, and polyethylene-ethyl acrylate;

(b) metallocene-catalyzed polymers;

(c) ethylene-butyl acrylate-carbon monoxide polymers and ethylene-vinyl acetate-carbon monoxide polymers;

(d) polyethylene-vinyl acetates;

(e) ethylene-alkyl acrylate polymers containing a cure site monomer;

(f) ethylene-propylene rubbers and ethylene-propylene-diene monomer rubbers;

(g) olefinic ethylene elastomers, particularly ethylene-octene polymers, ethylene-butene polymers, ethylene-propylene polymers, and ethylene-hexene polymers;

(h) styrenic block copolymers;

(i) polyester elastomers;

(j) polyamide elastomers;

(k) polyolefin rubbers, particularly polybutadiene, polyisoprene, and styrene-butadiene rubber; and (l) thermoplastic polyurethanes.

Examples of particularly suitable commercially available non-acid polymers include, but are not limited to, Lotader® ethylene-alkyl acrylate polymers and Lotryl® ethylene-alkyl acrylate polymers, and particularly Lotader® 4210, 4603, 4700, 4720, 6200, 8200, and AX8900 commercially available from Arkema Corporation; Elvaloy® AC ethylene-alkyl acrylate polymers, and particularly AC 1224, AC 1335, AC 2116, AC3117, AC3427, and AC34035, commercially available from E. I. du Pont de Nemours and Company; Fusabond® elastomeric polymers, such as ethylene vinyl acetates, polyethylenes, metallocene-catalyzed polyethylenes, ethylene propylene rubbers, and polypropylenes, and particularly Fusabond® N525, C190, C250, A560, N416, N493, N614, P614, M603, E100, E158, E226, E265, E528, and E589, commercially available from E. I. du Pont de Nemours and Company; Honeywell A-C polyethylenes and ethylene maleic anhydride copolymers, and particularly A-C 5180, A-C 575, A-C 573, A-C 655, and A-C 395, commercially available from Honeywell; Nordel® IP rubber, Elite® polyethylenes, Engage® elastomers, and Amplify® functional polymers, and particularly Amplify® GR 207, GR 208, GR 209, GR 213, GR 216, GR 320, GR 380, and EA 100, commercially available from The Dow Chemical Company; Enable® metallocene polyethylenes, Exact® plastomers, Vistamaxx® propylene-based elastomers, and Vistalon® EPDM rubber, commercially available from ExxonMobil Chemical Company; Starflex® metallocene linear low density polyethylene, commercially available from LyondellBasell; Elvaloy® HP4051, HP441, HP661 and HP662 ethylene-butyl acrylate-carbon monoxide polymers and Elvaloy® 741, 742 and 4924 ethylene-vinyl acetate-carbon monoxide polymers, commercially available from E. I. du Pont de Nemours and Company; Evatane® ethylene-vinyl acetate polymers having a vinyl acetate content of from 18 to 42%, commercially available from Arkema Corporation; Elvax® ethylene-vinyl acetate polymers having a vinyl acetate content of from 7.5 to 40%, commercially available from E. I. du Pont de Nemours and Company; Vamac® G terpolymer of ethylene, methylacrylate and a cure site monomer, commercially available from E. I. du Pont de Nemours and Company; Vistalon® EPDM rubbers, commercially available from ExxonMobil Chemical Company; Kraton® styrenic block copolymers, and particularly Kraton® FG1901GT, FG1924GT, and RP6670GT, commercially available from Kraton Performance Polymers Inc.; Septon® styrenic block copolymers, commercially available from Kuraray Co., Ltd.; Hytrel® polyester elastomers, and particularly Hytrel® 3078, 4069, and 556, commercially available from E. I. du Pont de Nemours and Company; Riteflex® polyester elastomers, commercially available from Celanese Corporation; Pebax® thermoplastic polyether block amides, and particularly Pebax® 2533, 3533, 4033, and 5533, commercially available from Arkema Inc.; Affinity® and Affinity® GA elastomers, Versify® ethylene-propylene copolymer elastomers, and Infuse® olefin block copolymers, commercially available from The Dow Chemical Company; Exxelor® polymer resins, and particularly Exxelor® PE 1040, PO 1015, PO 1020, VA 1202, VA 1801, VA 1803, and VA 1840, commercially available from ExxonMobil Chemical Company; and Royaltuf® EPDM, and particularly Royaltuf®498 maleic anhydride modified polyolefin based on an amorphous EPDM and Royaltuf®485 maleic anhydride modified polyolefin based on an semi-crystalline EPDM, commercially available from Chemtura Corporation.

In a particular embodiment, the intermediate layer is formed from a polyester elastomer composition comprising a polyester elastomer and an additional polymer selected from maleic anhydride-modified polyolefins.

The golf ball subassembly comprising the core and the intermediate layer is enclosed with a relatively hard outer cover layer.

The outer cover layer has a thickness of 0.020 or 0.030 or 0.060 or 0.080 or 0.120 inches, or a thickness within a range having a lower limit and an upper limit selected from these values.

The outer cover layer composition has a solid sphere COR of from 0.725 to 0.820, and a solid sphere compression of from 80 to 180.

The outer cover layer is preferably formed from a composition having a material hardness of 80 or 85 or 90 or 95 Shore C, or a material hardness within a range having a lower limit and an upper limit selected from these values.

Suitable outer cover layer materials include, but are not limited to, ionomer resins and blends thereof (e.g., Surlyn® ionomer resins and DuPont® HPF 1000 and HPF 2000, commercially available from E. I. du Pont de Nemours and Company; Iotek® ionomers, commercially available from ExxonMobil Chemical Company; Amplify® IO ionomers of ethylene acrylic acid copolymers, commercially available from The Dow Chemical Company; and Clarix® ionomer resins, commercially available from A. Schulman Inc.); polyurethanes; polyureas; copolymers and hybrids of polyurethane and polyurea; polyethylene, including, for example, low density polyethylene, linear low density polyethylene, and high density polyethylene; polypropylene; rubber-toughened olefin polymers; acid copolymers, e.g., (meth)acrylic acid, which do not become part of an ionomeric copolymer; plastomers; flexomers; styrene/butadiene/styrene block copolymers; styrene/ethylene/butylene/styrene block copolymers; dynamically vulcanized elastomers; ethylene vinyl acetates; ethylene methyl acrylates; polyvinyl chloride resins; polyamides, amide-ester elastomers, and graft copolymers of ionomer and polyamide, including, for example, Pebax® thermoplastic polyether block amides, commercially available from Arkema Inc; crosslinked trans-polyisoprene and blends thereof; polyester-based thermoplastic elastomers, such as Hytrel®, commercially available from E. I. du Pont de Nemours and Company; polyurethane-based thermoplastic elastomers, such as Elastollan®, commercially available from BASF; synthetic or natural vulcanized rubber; and combinations thereof. Suitable cover materials and constructions also include, but are not limited to, those disclosed in U.S. Pat. Nos. 6,117,025, 6,767,940, and 6,960,630, the entire disclosures of which are hereby incorporated herein by reference.

Polyurethanes, polyureas, and copolymers and blends thereof are particularly suitable for forming the outer cover layer in dual-layer covers. When used as cover layer materials, polyurethanes and polyureas can be thermoset or thermoplastic. Thermoset materials can be formed into golf ball layers by conventional casting or reaction injection molding techniques. Thermoplastic materials can be formed into golf ball layers by conventional compression or injection molding techniques.

Suitable polyurethane cover materials are further disclosed in U.S. Pat. Nos. 5,334,673, 6,506,851, 6,756,436, and 7,105,623, the entire disclosures of which are hereby incorporated herein by reference. Suitable polyurea cover materials are further disclosed in U.S. Pat. Nos. 5,484,870, 6,835,794 and 7,378,483, and U.S. Patent Application Publication No. 2008/0064527, the entire disclosures of which are hereby incorporated herein by reference. Suitable polyurethane-urea cover materials include polyurethane/polyurea blends and copolymers comprising urethane and urea segments, as disclosed in U.S. Patent Application Publication No. 2007/0117923, the entire disclosure of which is hereby incorporated herein by reference.

Particularly preferred ionomeric outer cover layer compositions include:

(a) a composition comprising a "high acid ionomer" (i.e., having an acid content of greater than 16 wt %), such as Surlyn 8150®;

(b) a composition comprising a high acid ionomer and a maleic anhydride-grafted non-ionomeric polymer (e.g., Fusabond® functionalized polymers). A particularly preferred blend of high acid ionomer and maleic anhydride-grafted polymer is a 84 wt %/16 wt % blend of Surlyn 8150® and Fusabond®. Blends of high acid ionomers with maleic anhydride-grafted polymers are further disclosed, for example, in U.S. Pat. Nos. 6,992,135 and 6,677,401, the entire disclosures of which are hereby incorporated herein by reference;

(c) a composition comprising a 50/45/5 blend of Surlyn® 8940/Surlyn® 9650/Nucrel® 960, preferably having a material hardness of from 80 to 85 Shore C;

(d) a composition comprising a 50/25/25 blend of Surlyn® 8940/Surlyn® 9650/Surlyn® 9910, preferably having a material hardness of about 90 Shore C;

(e) a composition comprising a 50/50 blend of Surlyn® 8940/Surlyn® 9650, preferably having a material hardness of about 86 Shore C;

(f) a composition comprising a blend of Surlyn® 7940/Surlyn® 8940, optionally including a melt flow modifier;

(g) a composition comprising a blend of a first high acid ionomer and a second high acid ionomer, wherein the first high acid ionomer is neutralized with a different cation than the second high acid ionomer (e.g., 50/50 blend of Surlyn® 8150 and Surlyn® 9150), optionally including one or more melt flow modifiers such as an ionomer, ethylene-acid copolymer or ester terpolymer;

(h) a composition comprising a blend of a first high acid ionomer and a second high acid ionomer, wherein the first high acid ionomer is neutralized with a different cation than the second high acid ionomer, and from 0 to 10 wt % of an ethylene/acid/ester ionomer wherein the ethylene/acid/ester ionomer is neutralized with the same cation as either the first high acid ionomer or the second high acid ionomer or a different cation than the first and second high acid ionomers (e.g., a blend of 40-50 wt % Surlyn® 8140, 40-50 wt % Surlyn® 9120, and 0-10 wt % Surlyn® 6320);

(i) a composition comprising a 60/25/15 blend of Surlyn® 9945/Surlyn® 8940/Surlyn® 8320;

(j) a composition comprising a 60/40 blend of Surlyn® 9945/Surlyn® 8320;

(k) a composition comprising an 80/20 blend of Surlyn® 9945/Surlyn® 8320;

(l) a composition comprising a 60/25/15 blend of Surlyn® 9945/Surlyn® 8940/Surlyn® AD1022;

(m) a composition comprising a 60/25/15 blend of Surlyn® 9945/Surlyn® 8940/Surlyn® AD 1043;

(n) a composition comprising a 60/40 blend of Surlyn® 9945/Surlyn® AD1022;

(o) a composition comprising a 60/40 blend of Surlyn® 9945/Surlyn® AD 1043;

(p) a composition comprising a single ionomer, wherein the ionomer is Surlyn® AD1043; and (q) a composition comprising a 57/20/23 blend of Surlyn® 7940/Surlyn® 8945/Fusabond® N525.

Surlyn 8150®, Surlyn® 8940, Surlyn® 8140, and Surlyn® 8320 are different grades of E/MAA copolymer in which the acid groups have been partially neutralized with sodium ions. Surlyn® 9650, Surlyn® 9910, Surlyn® 9150, Surlyn® 9120 and Surlyn® 9945 are different grades of E/MAA copolymer in which the acid groups have been partially neutralized with zinc ions. Surlyn® 7940 is an E/MAA copolymer in which the acid groups have been partially neutralized with lithium ions. Surlyn® 6320 is a very low modulus magnesium ionomer with a medium acid content. Nucrel® 960 is an E/MAA copolymer resin nominally made with 15 wt % methacrylic acid. Fusabond® 525D is a metallocene-catalyzed polyethylene. Surlyn® ionomers, Fusabond® polymers, and Nucrel® copolymers are commercially available from E. I. du Pont de Nemours and Company.

Suitable ionomers also include polypropylene ionomers, including grafted polypropylene ionomers. Examples of commercially available polypropylene ionomers include, but are not limited to, Clarix® 130640 and 230620 acrylic acid-grafted polypropylene ionomers, commercially available from A. Schulman Inc., and Priex® 40101, 42101, 45101, and 48101, maleic anhydride-grafted polypropylene ionomers, commercially available from Solvay Engineered Polymers, Inc.

Suitable ionomers also include polyester ionomers, including, but not limited to, those disclosed, for example, in U.S. Pat. Nos. 6,476,157 and 7,074,465, the entire disclosures of which are hereby incorporated herein by reference.

Suitable ionomers also include low molecular weight ionomers, such as AClyn® 201, 201A, 295, 295A, 246, 246A, 285, and 285A low molecular weight ionomers, commercially available from Honeywell International Inc.

Suitable ionomers also include ionomer compositions comprising an ionomer and potassium ions, such as those disclosed, for example, in U.S. Pat. No. 7,825,191, the entire disclosure of which is hereby incorporated herein by reference.

Ionomeric cover compositions can be blended with non-ionic thermoplastic resins, particularly to manipulate product properties. Examples of suitable non-ionic thermoplastic resins include, but are not limited to, polyurethane, polyether-ester, poly-amide-ether, polyether-urea, thermoplastic polyether block amides (e.g., Pebax® block copolymers, commercially available from Arkema Inc.), styrene-butadiene-styrene block copolymers, styrene(ethylene-butylene)-styrene block copolymers, polyamides, polyesters, polyolefins (e.g., polyethylene, polypropylene, ethylene-propylene copolymers, polyethylene-(meth)acrylate, polyethylene-(meth)acrylic acid, functionalized polymers with maleic anhydride grafting, Fusabond® functionalized polymers commercially available from E. I. du Pont de Nemours and Company, functionalized polymers with epoxidation, elastomers (e.g., ethylene propylene diene monomer rubber, metallocene-catalyzed polyolefin) and ground powders of thermoset elastomers.

Ionomer golf ball cover compositions may include a flow modifier, such as, but not limited to, acid copolymer resins (e.g., Nucrel® acid copolymer resins, and particularly Nucrel® 960, commercially available from E. I. du Pont de Nemours and Company), performance additives (e.g., A-C® performance additives, particularly A-C® low molecular weight ionomers and copolymers, A-C® oxidized polyethylenes, and A-C® ethylene vinyl acetate waxes, commercially available from Honeywell International Inc.), fatty acid amides (e.g., ethylene bis-stearamide and ethylene bis-oleamide), and fatty acids and salts thereof.

Non-limiting examples of particularly preferred ionomeric cover layer formulations are shown in Table 1 below.

TABLE 1

| Cover Layer Material | Surlyn ® 8150, wt % | Fusabond ®, wt % | Shore C Hardness* |
|---|---|---|---|
| 1 | 89 | 11 | 91.2 |
| 2 | 84 | 16 | 89.8 |
| 3 | 84 | 16 | 90.4 |
| 4 | 84 | 16 | 89.6 |
| 5 | 81 | 19 | 88.9 |
| 6 | 80 | 20 | 89.1 |
| 7 | 78 | 22 | 88.1 |
| 8 | 76 | 24 | 87.6 |
| 9 | 76 | 24 | 87.2 |
| 10 | 73 | 27 | 86.6 |
| 11 | 71 | 29 | 86.7 |
| 12 | 67 | 33 | 84.0 |

*Flex bars of each blend composition were formed and evaluated for hardness according to ASTM D2240 following 10 days of aging at 50% relative humidity and 23° C.

Suitable ionomeric cover materials are further disclosed, for example, in U.S. Patent Application Publication Nos. 2005/0049367, 2005/0148725, 2005/0020741, 2004/0220343, and 2003/0130434, and U.S. Pat. Nos. 5,587,430, 5,691,418, 5,866,658, 6,100,321, 6,562,906, 6,653,382, 6,756,436, 6,777,472, 6,762,246, 6,815,480, 6,894,098, 6,919,393, and 6,953,820, the entire disclosures of which are hereby incorporated herein by reference.

Golf ball cover compositions may include a flow modifier, such as, but not limited to, Nucrel® acid copolymer resins, and particularly Nucrel® 960. Nucrel® acid copolymer resins are commercially available from E. I. du Pont de Nemours and Company.

Cover compositions may also include one or more filler(s), such as the fillers given above for rubber compositions of the present invention (e.g., titanium dioxide, barium sulfate, etc.), and/or additive(s), such as coloring agents, fluorescent agents, whitening agents, antioxidants, dispersants, UV absorbers, light stabilizers, plasticizers, surfactants, compatibility agents, foaming agents, reinforcing agents, release agents, and the like.

Additional suitable cover materials are disclosed, for example, in U.S. Patent Application Publication No. 2005/0164810, U.S. Pat. No. 5,919,100, and PCT Publications WO00/23519 and WO00/29129, the entire disclosures of which are hereby incorporated herein by reference.

A moisture vapor barrier layer is optionally employed between the core and the cover. Moisture vapor barrier layers are further disclosed, for example, in U.S. Pat. Nos. 6,632,147, 6,932,720, 7,004,854, and 7,182,702, the entire disclosures of which are hereby incorporated herein by reference.

Compositions disclosed herein can be either foamed or filled with density adjusting materials to provide desirable golf ball performance characteristics.

The present invention is not limited by any particular process for forming the golf ball layer(s). It should be understood that the layer(s) can be formed by any suitable technique, including injection molding, compression molding, casting, and reaction injection molding.

When injection molding is used, the composition is typically in a pelletized or granulated form that can be easily fed into the throat of an injection molding machine wherein it is melted and conveyed via a screw in a heated barrel at temperatures of from 150° F. to 600° F., preferably from 200° F. to 500° F. The molten composition is ultimately injected into a closed mold cavity, which may be cooled, at ambient or at an elevated temperature, but typically the mold is cooled to a temperature of from 50° F. to 70° F. After residing in the closed mold for a time of from 1 second to 300 seconds, preferably from 20 seconds to 120 seconds, the core and/or core plus one or more additional core or cover layers is removed from the mold and either allowed to cool at ambient or reduced temperatures or is placed in a cooling fluid such as water, ice water, dry ice in a solvent, or the like.

When compression molding is used to form a core, the composition is first formed into a preform or slug of material, typically in a cylindrical or roughly spherical shape at a weight slightly greater than the desired weight of the molded core. Prior to this step, the composition may be first extruded or otherwise melted and forced through a die after which it is cut into a cylindrical preform. The preform is then placed into a compression mold cavity and compressed at a mold temperature of from 150° F. to 400° F., preferably from 250° F. to 400° F., and more preferably from 300° F. to 400° F. When compression molding a cover layer, half-shells of the cover layer material are first formed via injection molding. A core is then enclosed within two half-shells, which is then placed into a compression mold cavity and compressed.

Reaction injection molding processes are further disclosed, for example, in U.S. Pat. Nos. 6,083,119, 7,208,562, 7,281,997, 7,282,169, 7,338,391, and U.S. Patent Application Publication No. 2006/0247073, the entire disclosures of which are hereby incorporated herein by reference.

COR, as used herein, is determined according to a known procedure wherein a golf ball or golf ball subassembly (e.g., a golf ball core) is fired from an air cannon at two given velocities and calculated at a velocity of 125 ft/s. Ballistic light screens are located between the air cannon and the steel plate at a fixed distance to measure ball velocity. As the ball travels toward the steel plate, it activates each light screen, and the time at each light screen is measured. This provides an incoming transit time period inversely proportional to the ball's incoming velocity. The ball impacts the steel plate and rebounds though the light screens, which again measure the time period required to transit between the light screens. This provides an outgoing transit time period inversely proportional to the ball's outgoing velocity. COR is then calculated as the ratio of the outgoing transit time period to the incoming transit time period, $COR=V_{out}/V_{in}=T_{in}/T_{out}$.

Golf balls of the present invention typically have an overall compression of 30 or greater, or 40 or greater, or a compression of 30 or 40 or 50 or 60 or 65 or 75 or 80 or 90 or 95 or 100, or a compression within a range having a lower limit and an upper limit selected from these values. Dual cores of the present invention preferably have an overall compression of 60 or 70 or 75 or 80 and an upper limit of 85 or 90 or 95 or 100. Inner core layers of the present invention preferably have a compression of 40 or less, or from 20 to 40, or a compression of about 35.

Compression is an important factor in golf ball design. For example, the compression of the core can affect the ball's spin rate off the driver and the feel. As disclosed in Jeff Dalton's *Compression by Any Other Name, Science and Golf IV, Proceedings of the World Scientific Congress of Golf* (Eric Thain ed., Routledge, 2002) ("J. Dalton"), several different methods can be used to measure compression, including Atti compression, Riehle compression, load/deflection measurements at a variety of fixed loads and offsets, and effective modulus. For purposes of the present invention, "compression" refers to Atti compression and is measured according to a known procedure, using an Atti compression test device, wherein a piston is used to compress a ball against a spring. The travel of the piston is fixed and the deflection of the spring is measured. The measurement of the deflection of the spring does not begin with its contact with the ball; rather, there is an offset of approximately the first 1.25 mm (0.05 inches) of the spring's deflection. Very low stiffness cores will not cause the spring to deflect by more than 1.25 mm and therefore have a zero compression measurement. The Atti compression tester is designed to measure objects having a diameter of 42.7 mm (1.68 inches); thus, smaller objects, such as golf ball cores, must be shimmed to a total height of 42.7 mm to obtain an accurate reading. Conversion from Atti compression to Riehle (cores), Riehle (balls), 100 kg deflection, 130-10 kg deflection or effective modulus can be carried out according to the formulas given in J. Dalton.

Golf balls of the present invention will typically have dimple coverage of 60% or greater, preferably 65% or greater, and more preferably 75% or greater.

The United States Golf Association specifications limit the minimum size of a competition golf ball to 1.680 inches. There is no specification as to the maximum diameter, and golf balls of any size can be used for recreational play. Golf balls of the present invention can have an overall diameter of any size. The preferred diameter of the present golf balls is from 1.680 inches to 1.800 inches. More preferably, the present golf balls have an overall diameter of from 1.680 inches to 1.760 inches, and even more preferably from 1.680 inches to 1.740 inches.

Golf balls of the present invention preferably have a moment of inertia ("MOI") of 70-95 $g\cdot cm^2$, preferably 75-93 $g\cdot cm^2$, and more preferably 76-90 $g\cdot cm^2$. For low MOI embodiments, the golf ball preferably has an MOI of 85 $g\cdot cm^2$ or less, or 83 $g\cdot cm^2$ or less. For high MOI embodiment, the golf ball preferably has an MOI of 86 $g\cdot cm^2$ or greater, or 87 g·cm$^2$ or greater. MOI is measured on a model MOI-005-104 Moment of Inertia Instrument manufactured by Inertia Dynamics of Collinsville, Conn. The instrument is connected to a PC for communication via a COMM port and is driven by MOI Instrument Software version #1.2.

For purposes of the present disclosure, center hardness is obtained according to the following procedure. The core is gently pressed into a hemispherical holder having an internal diameter approximately slightly smaller than the diameter of the core, such that the core is held in place in the hemispherical portion of the holder while concurrently leaving the geometric central plane of the core exposed. The core is secured in the holder by friction, such that it will not move during the cutting and grinding steps, but the friction is not so excessive that distortion of the natural shape of the core would result. The core is secured such that the parting line of the core is roughly parallel to the top of the holder. The diameter of the core is measured 90 degrees to this orientation prior to securing. A measurement is also made from the bottom of the holder to the top of the core to provide a reference point for future calculations. A rough cut is made slightly above the exposed geometric center of the core using a band saw or other appropriate cutting tool, making sure that the core does not move in the holder during this step. The remainder of the core, still in the holder, is secured to the base plate of a surface grinding machine. The exposed 'rough' surface is ground to a smooth, flat surface, revealing the geometric center of the core, which can be verified by measuring the height from the bottom of the holder to the exposed surface of the core, making sure that exactly half of the original height of the core, as measured above, has been removed to within ±0.004 inches. Leaving the core in the holder, the center of the core is found with a center square and carefully marked and the hardness is measured at the center mark according to ASTM D-2240. Additional hardness measurements at any distance from the center of the core can then be made by drawing a line radially outward from the center mark, and measuring the hardness at any given distance along the line, typically in 2 mm increments from the center. The hardness at a particular distance from the center should be measured along at least two, preferably four, radial arms located 180° apart, or 90° apart, respectively, and then averaged. All hardness measurements performed on a plane passing through the geometric center are performed while the core is still in the holder and without having disturbed its orientation, such that the test surface is constantly parallel to the bottom of the holder, and thus also parallel to the properly aligned foot of the durometer.

For purposes of the present disclosure, the outer surface hardness of a golf ball layer is measured on the actual outer surface of the layer and is obtained from the average of a number of measurements taken from opposing hemispheres, taking care to avoid making measurements on the parting line of the core or on surface defects, such as holes or protrusions. Hardness measurements are made pursuant to ASTM D-2240 "Indentation Hardness of Rubber and Plastic by Means of a Durometer." Because of the curved surface, care must be taken to insure that the golf ball or golf ball subassembly is centered under the durometer indentor before a surface hardness reading is obtained. A calibrated, digital durometer, capable of reading to 0.1 hardness units is used for all hardness measurements and is set to take hardness readings at 1 second after the maximum reading is obtained. The digital durometer must be attached to, and its foot made parallel to, the base of an automatic stand. The weight on the durometer and attack rate conform to ASTM D-2240.

It should be understood that there is a fundamental difference between "material hardness" and "hardness as measured directly on a golf ball." For purposes of the present disclosure, material hardness is measured according to ASTM D2240 and generally involves measuring the hardness of a flat "slab" or "button" formed of the material. Hardness as measured directly on a golf ball (or other spherical surface) typically results in a different hardness value. This difference in hardness values is due to several factors including, but not limited to, ball construction (i.e., core type, number of core and/or cover layers, etc.), ball (or sphere) diameter, and the material composition of adjacent layers. It should also be understood that the two measurement techniques are not linearly related and, therefore, one hardness value cannot easily be correlated to the other. Unless otherwise stated, the material hardness values given herein for cover materials are measured according to ASTM D2240, with all values reported following 10 days of aging at 50% relative humidity and 23° C.

Thermoplastic layers of golf balls disclosed herein may be treated in such a manner as to create a positive or negative hardness gradient, as disclosed, for example, in U.S. patent application Ser. No. 11/939,632, filed Nov. 14, 2007; Ser. No. 11/939,634, filed Nov. 14, 2007; Ser. No. 11/939,635, filed Nov. 14, 2007; and Ser. No. 11/939,637 filed Nov. 14, 2007. The entire disclosure of each of these references is hereby incorporated herein by reference. In golf ball layers of the present invention wherein a thermosetting rubber is used, gradient-producing processes and/or gradient-producing rubber formulations may be employed, as disclosed, for example, in U.S. patent application Ser. Nos. 12/048,665, filed Mar. 14, 2008; Ser. No. 11/829,461, filed Jul. 27, 2007; Ser. No. 11/772,903, filed Jul. 3, 2007; Ser. No. 11/832,163, filed Aug. 1, 2007; and U.S. Pat. No. 7,410,429. The entire disclosure of each of these references is hereby incorporated herein by reference.

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball having a compression of from 30 to 90 and comprising:

a center having a diameter of from 1.25 inches to 1.40 inches, a center Shore C hardness ($H_{center}$) of from 45 to 60, an outer surface Shore C hardness ($H_{core\ surface}$) of from 80 to 95, and formed from a rubber composition;

an intermediate layer having an outer surface Shore C hardness ($H_{intermediate\ surface}$) of from 55 to 80, a thickness of from 0.020 inches to 0.120 inches, and formed from a polyester elastomer composition having a material hardness of from 50 Shore C to 80 Shore C and comprising a polyester elastomer and an additional polymer selected from the group consisting of polyolefins, polyamides, polyesters, polyethers, polyurethanes, metallocene-catalyzed polymers, single-site catalyst polymerized polymers, ethylene propylene rubber, ethylene propylene diene rubber, styrenic block copolymer rubbers, alkyl acrylate rubbers, chlorinated polyethylene, polyvinyl chloride, chlorinated polyvinyl chloride, and functionalized derivatives thereof, wherein the polyester elastomer is present in an amount of from 20 wt % to 90 wt % and the additional polymer is present in an amount of from 10 wt % to 80 wt %, based on the combined weight of the polyester elastomer and the additional polymer; and an outer cover layer having an outer surface Shore C hardness ($H_{outer\ cover\ surface}$) of from 82 to 99 and a thickness of from 0.020 inches to 0.080 inches;

wherein $H_{center}<H_{intermediate\ surface}<H_{core\ surface}<H_{outer\ cover\ surface}$;

wherein the difference between $H_{core\ surface}$ and $H_{intermediate\ surface}$ is from 5 to 30; and wherein the difference between $H_{center}$ and $H_{core\ surface}$ is 35 or greater.

2. The golf ball of claim 1, wherein the additional polymer of the polyester elastomer composition of the intermediate layer is a maleic anhydride-modified polyolefin.

3. The golf ball of claim 1, wherein the compression of the golf ball is from 40 to 80.

4. The golf ball of claim 1, wherein the compression of the golf ball is from 50 to 75.

5. The golf ball of claim 1, wherein the polyester elastomer composition of the intermediate layer has a solid sphere compression of from −50 to 50.

6. The golf ball of claim 1, wherein the ratio of the overall ball compression to the solid sphere compression of the polyester elastomer composition of the intermediate layer is <1.00.

7. The golf ball of claim 1, wherein the outer cover layer is formed from a composition selected from ionomers, polyurethanes, polyureas, and blends thereof.

8. The golf ball of claim 7, wherein the outer cover layer composition has a solid sphere compression of from 80 to 180.

9. The golf ball of claim 1, wherein the intermediate layer has a thickness of from 0.030 inches to 0.060 inches.

10. The golf ball of claim 1, wherein the difference between $H_{core\ surface}$ and $H_{intermediate\ surface}$ is from 10 to 25.

11. A golf ball having a compression of from 30 to 90 and comprising:

a dual core having an outer diameter of from 1.25 inches to 1.40 inches, a center Shore C hardness ($H_{center}$) of from 45 to 60, an outer surface Shore C hardness ($H_{core\ surface}$) of from 80 to 95, and consisting of a center formed from a first rubber composition and an outer core layer formed from a second rubber composition;

an intermediate layer having an outer surface Shore C hardness ($H_{intermediate\ surface}$) of from 55 to 80, a thickness of from 0.020 inches to 0.120 inches, and formed from a polyester elastomer composition having a material hardness of from 50 Shore C to 80 Shore C and comprising a polyester elastomer and an additional polymer selected from the group consisting of polyolefins, polyamides, polyesters, polyethers, polyurethanes, metallocene-catalyzed polymers, single-site catalyst polymerized polymers, ethylene propylene rubber, ethylene propylene diene rubber, styrenic block copolymer rubbers, alkyl acrylate rubbers, chlorinated polyethylene, polyvinyl chloride, chlorinated polyvinyl chloride, and functionalized derivatives thereof, wherein the polyester elastomer is present in an amount of from 20 wt % to 90 wt % and the additional polymer is present in an amount of from 10 wt % to 80 wt %, based on the combined weight of the polyester elastomer and the additional polymer; and an outer cover layer having an outer surface Shore C hardness ($H_{outer\ cover\ surface}$) of from 82 to 99 and a thickness of from 0.020 inches to 0.080 inches;

wherein $H_{center}<H_{intermediate\ surface}<H_{core\ surface}<H_{outer\ cover\ surface}$;

wherein the difference between $H_{core\ surface}$ and $H_{intermediate\ surface}$ is from 5 to 30; and wherein the difference between $H_{center}$ and $H_{core\ surface}$ is 35 or greater.

12. The golf ball of claim 11, wherein the additional polymer of the polyester elastomer composition of the intermediate layer is a maleic anhydride-modified polyolefin.

13. The golf ball of claim 11, wherein the compression of the golf ball is from 40 to 80.

14. The golf ball of claim 11, wherein the compression of the golf ball is from 50 to 75.

15. The golf ball of claim 11, wherein the polyester elastomer composition of the intermediate layer has a solid sphere compression of from −50 to 50.

16. The golf ball of claim 11, wherein the ratio of the overall ball compression to the solid sphere compression of the polyester elastomer composition of the intermediate layer is <1.00.

17. The golf ball of claim 11, wherein the outer cover layer is formed from a composition selected from ionomers, polyurethanes, polyureas, and blends thereof.

18. The golf ball of claim 17, wherein the outer cover layer composition has a solid sphere compression of from 80 to 180.

19. The golf ball of claim 11, wherein the intermediate layer has a thickness of from 0.030 inches to 0.060 inches.

20. The golf ball of claim 11, wherein the difference between $H_{core\ surface}$ and $H_{intermediate\ surface}$ is from 10 to 25.

* * * * *